US009302515B2

(12) United States Patent
Iwao et al.

(10) Patent No.: US 9,302,515 B2
(45) Date of Patent: Apr. 5, 2016

(54) PRINTER

(71) Applicant: FUJITSU COMPONENT LIMITED, Tokyo (JP)

(72) Inventors: Takashi Iwao, Tokyo (JP); Masaki Noguchi, Tokyo (JP); Tetsuhiro Ishikawa, Tokyo (JP)

(73) Assignee: FUJITSU COMPONENT LIMITED, Toyko (JP)

( * ) Notice: Subject to any disclaimer, the term of this patent is extended or adjusted under 35 U.S.C. 154(b) by 0 days.

(21) Appl. No.: 14/474,374

(22) Filed: Sep. 2, 2014

(65) Prior Publication Data

US 2015/0109395 A1 Apr. 23, 2015

(30) Foreign Application Priority Data

Oct. 17, 2013 (JP) ..... 2013-216729

(51) Int. Cl.
*B41J 29/02* (2006.01)
*B41J 15/04* (2006.01)

(52) U.S. Cl.
CPC ..... *B41J 29/02* (2013.01); *B41J 15/042* (2013.01)

(58) Field of Classification Search
USPC ..... 347/108
See application file for complete search history.

(56) References Cited

U.S. PATENT DOCUMENTS

| | | | | |
|---|---|---|---|---|
| 5,106,219 | A * | 4/1992 | Wyhof | 400/680 |
| 6,078,346 | A | 6/2000 | Isobe et al. | |
| 6,607,322 | B2 * | 8/2003 | Aruga et al. | 400/613 |
| 6,736,502 | B2 * | 5/2004 | Deguchi | 347/108 |
| 7,828,239 | B2 | 11/2010 | Ito | |
| 2011/0115866 | A1 * | 5/2011 | Izuma et al. | 347/104 |

FOREIGN PATENT DOCUMENTS

| | | |
|---|---|---|
| JP | H10-138590 | 5/1998 |
| JP | 2009-143695 | 7/2009 |
| JP | 2011-245870 | 12/2011 |

* cited by examiner

*Primary Examiner* — An Do
*Assistant Examiner* — Renee I Wilson
(74) *Attorney, Agent, or Firm* — IPUSA, PLLC

(57) ABSTRACT

A printer includes a print head configured to print on recording paper, and a printer main body having a case in which the recording paper is set. The case includes a upper case part and a lower case part, and a size of the case is changeable by changing positions at which the upper case part and the lower case part are connected to each other.

3 Claims, 8 Drawing Sheets

PRINTER

BACKGROUND OF THE INVENTION

1. Field of the Invention

The disclosures herein relate to a printer.

2. Description of the Related Art

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a predetermined length of the recording paper is cut from the rest of the paper.

Such a printer includes a printer main body and a lid that is rotatably supported by the printer main body. This lid is opened when setting a roll of recording paper in the printer main body. In such a configuration, the thermal head or the like is mounted in the printer main body, and a platen roller is mounted on the lid. Upon the lid being closed, the recording paper is placed between the thermal head or the like and the platen roller. The thermal head or the like prints on the recording paper while the thermal head or the like and the platen roller have the recording paper placed therebetween.

The printer has a cutter mounted thereon, which has a movable blade and a fixed blade to cut the recording paper. With the recording paper being placed between the movable blade and the fixed blade, the movable blade moves toward the fixed blade to cut the recording paper.

A printer having a thermal head mounted thereon generally utilizes a roll of recording paper. There are various types of rolls of recording paper, which may have different diameters, for example. A printer may be designed to take into account a roll having a large diameter. Such a printer allows both a roll of recording paper with a large diameter and a roll of recording paper with a small diameter to be used, but tends to become voluminous.

In general, it is highly required for a printer having a thermal head mounted thereon to have a small size. In cases where a recording paper roll having a small diameter is solely or predominantly used, it is not preferable to employ a large-sized printer allowing the use of a recording paper roll having a large diameter.

A small-sized printer dedicated for a recording paper roll having a small diameter may be manufactured. However, the usage of such a printer is limited because a recording paper roll having a large diameter cannot be used.

It may be desirable to provide a printer that allows both a large-diameter paper roll and a small-diameter paper roll to be used and whose size can be reduced when a small-diameter paper roll is used.

[Patent Document 1] Japanese Patent Application Publication No. 10-138590

[Patent Document 2] Japanese Patent Application Publication No. 2009-143695

[Patent Document 3] Japanese Patent Application Publication No. 2011-245870

SUMMARY OF THE INVENTION

According to an embodiment, a printer includes a print head configured to print on recording paper, and a printer main body having a case in which the recording paper is set, wherein the case includes a upper case part and a lower case part, and a size of the case is changeable by changing positions at which the upper case part and the lower case part are connected to each other.

According to at least one embodiment, the printer size can be reduced in response to the size of a roll of recording paper, so that the printer size may be reduced when a roll of recording paper having a small diameter is used.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments will be described by referring to the accompanying drawings. The same or similar elements are referred to by the same or similar numerals.

First Embodiment

Figure 1:
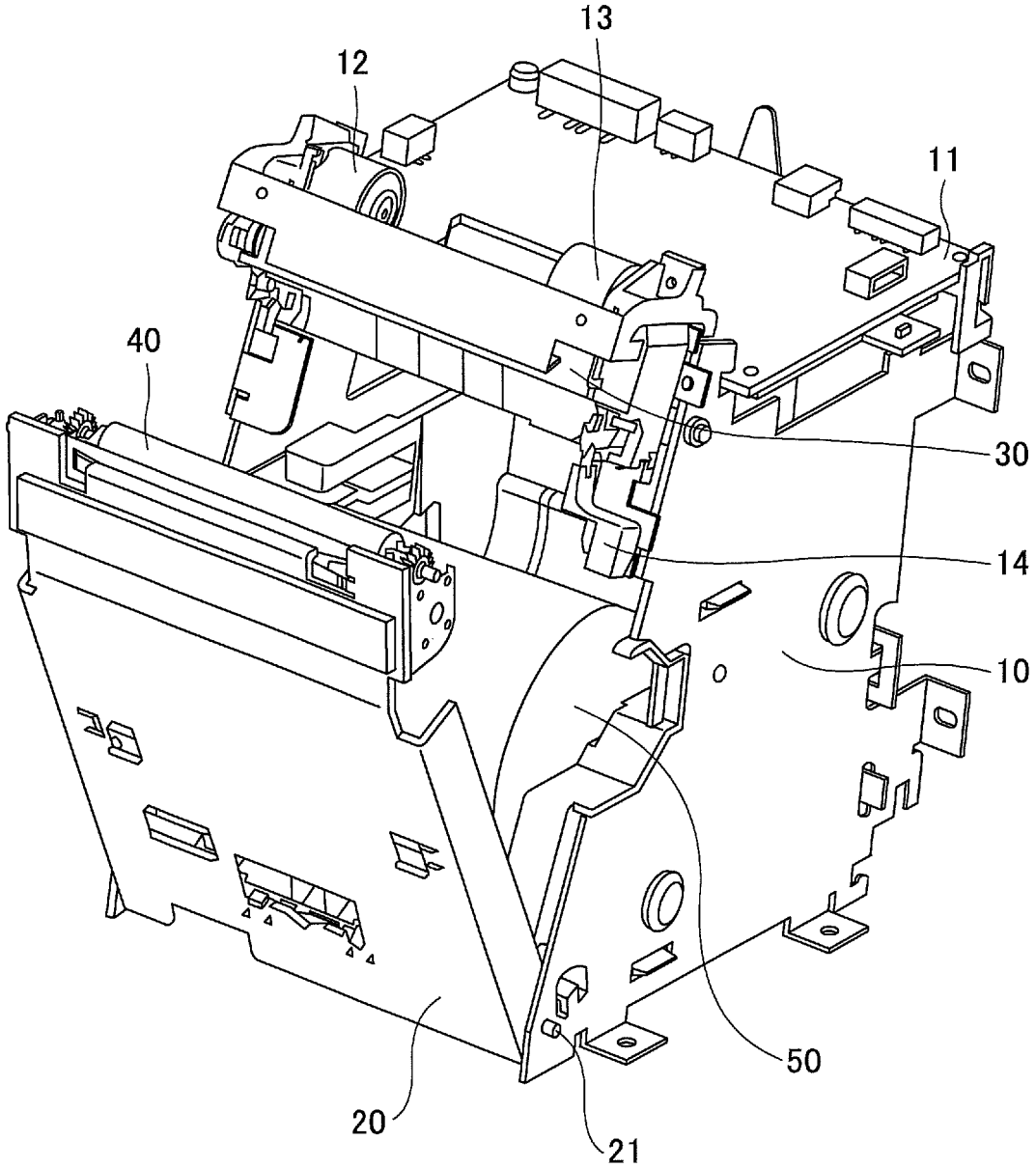
FIG. 1 is an oblique perspective view of a printer.

A description will be first given of a printer having a thermal head with reference to FIG. 1. The printer includes a printer main body 10, a lid 20, a thermal head 30, and a platen roller 40.

The printer main body 10 has a recording paper placement area in which a roll of recording paper 50 is placed. The printer main body 10 includes a control board 11, a conveyance motor 12, a cutter drive motor 13, and a lever 14. The thermal head 30 is mounted on the printer main body 10. The control board 11 is a printed circuit board for controlling the operations of the printer, and has ICs, connectors and the like mounted thereon. The conveyance motor 12 serves to convey the recording paper 50. The cutter drive motor 13 serves to drive a cutter for cutting the recording paper 50. The cutter has a fixed blade and a movable blade. The cutter drive motor 13 moves the movable blade toward the fixed blade to cut the recording paper 50.

The lid 20 is attached to the printer main body 10 such that the lid 20 can be opened and closed. Specifically, the lid 20 is attached to the printer main body 10 such that the lid 20 can be opened and closed by rotating around a shaft 21. The platen roller 40 is mounted on the lid 20.

The thermal head 30 is a print head for printing on the recording paper 50. With the recording paper 50 being placed between the thermal head 30 and the platen roller 40, the thermal head 30 prints on the recording paper 50. Closing the lid 20 attached to the printer main body 10 causes the thermal head 30 and the platen roller 40 to come in contact with each other, or causes the thermal head and the platen roller 40 to have the recording paper 50 placed therebetween.

The lever 14 mounted on the printer main body 10 is used to open the lid 20. Operating the lever 14 allows the lid 20 to open based on the restoring force of a spring or the like (not shown).

When the lid 20 is in the open state, the printer main body 10 allows the recording paper 50 to be placed in the recording paper placement area provided therein. After the recording paper 50 is placed inside the printer main body 10, the lid 20 is closed such that the thermal head 30 and the platen roller 40 have the recording paper 50 placed therebetween, thereby making it possible for the thermal head 30 to print on the recording paper 50.

<Printer>

In the following, a printer according to a first embodiment will be described. The printer of the present embodiment can change the size of the space in which the recording paper 50 is placed by changing the size of the printer main body 10 as illustrated in FIGS. 2A through 2C and FIGS. 3A through 3C.

Figure 2A:
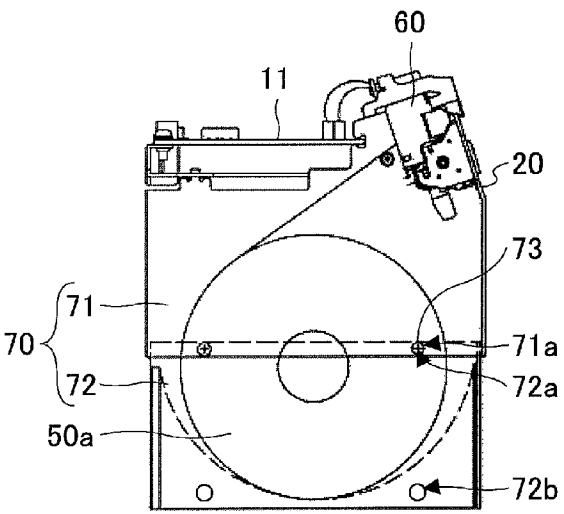
FIGS. 2A through 2C are drawings illustrating a printer of a first embodiment.
Figure 2B:
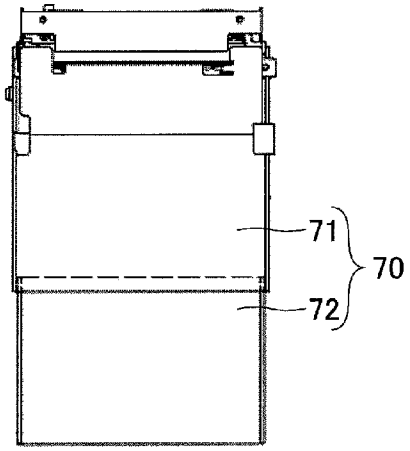
Figure 2C:
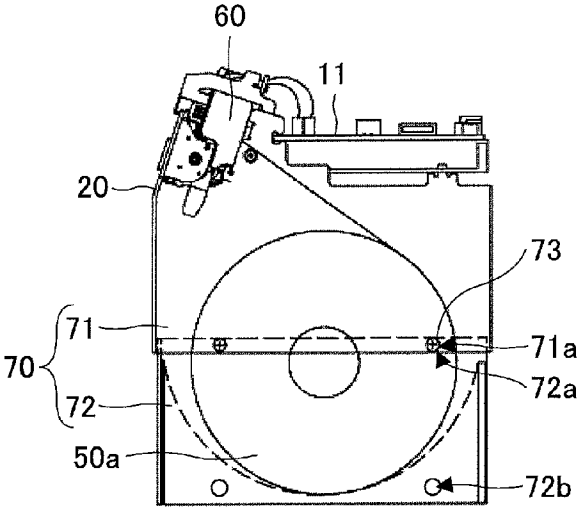
Figure 3C:
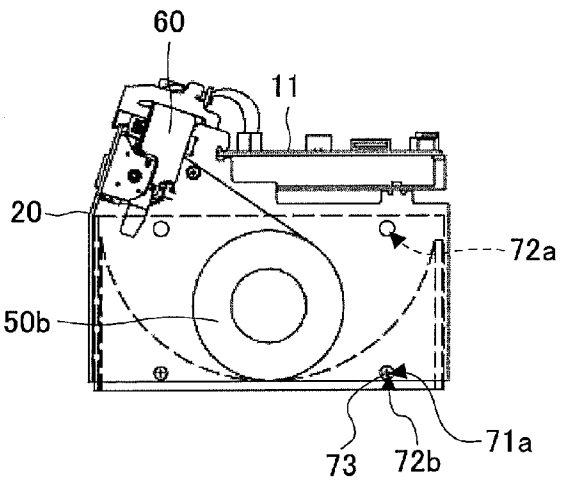
FIGS. 3A through 3C are drawings illustrating the printer of the first embodiment.
Figure 3B:
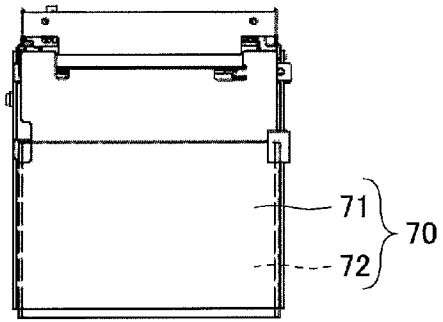
Figure 3A:
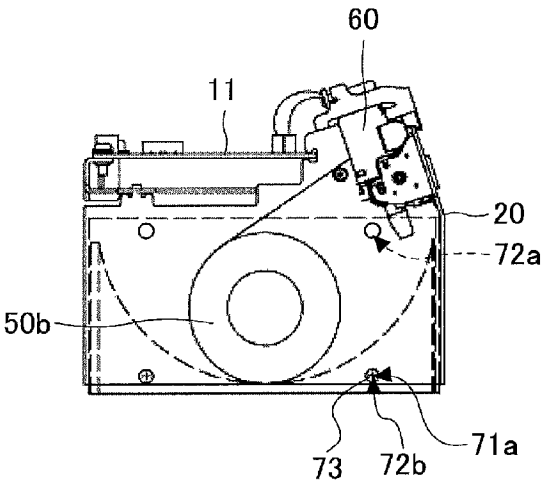

FIGS. 2A through 2C illustrate a case in which a roll of recording paper 50*a* having a large diameter is set. FIGS. 3A through 3C illustrate a case in which a roll of recording paper 50*b* having a small diameter is set. FIG. 2A is a partially transparent left lateral view of the printer of the present embodiment in which a large-diameter paper roll 50*a* is set. FIG. 2B is a front view of the printer. FIG. 2C is a partially transparent right lateral view of the printer. FIG. 3A is a partially transparent left lateral view of the printer of the present embodiment in which a small-diameter paper roll 50*b* is set. FIG. 3B is a front view of the printer. FIG. 3C is a partially transparent right lateral view of the printer.

Figure 4A:
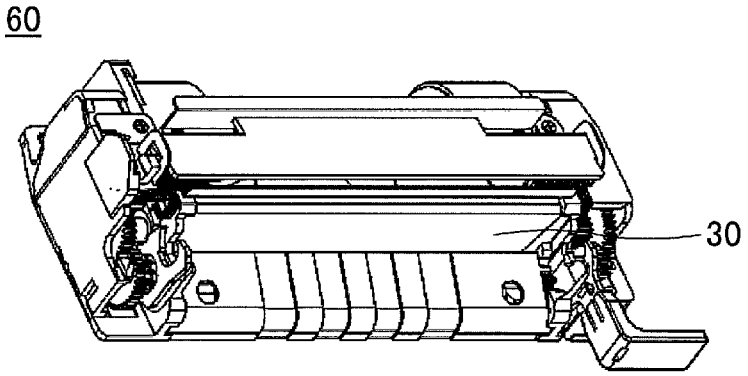
FIGS. 4A and 4B are drawings illustrating a printer mechanism.
Figure 4B:
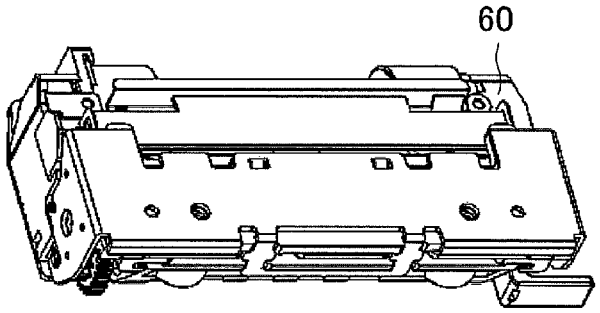

The printer main body 10 has a printer mechanism 60 attached thereto that is illustrated in FIG. 4A. The thermal head 30 is attached to the printer mechanism 60. FIG. 4A illustrates the printer mechanism 60 attached to the printer main body 10 as appears when the lid 20 is open. FIG. 4B illustrates the printer mechanism 60 as appears when the lid 20 is closed.

In the present embodiment, a case 70 of the printer main body 10 includes an upper case part 71 and a lower case part 72 as illustrated in FIGS. 2A through 2C and FIGS. 3A through 3C. The upper case part 71 has the printer mechanism 60 mounted on the top thereof, and has screw holes 71*a* at the lower portion thereof. The lower case part 72 has upper screw holes 72*a* at the upper portion thereof, and has lower screw holes 72*b* at the lower portion thereof. The upper case part 71 and the lower case part 72 are made of resin material or metal material.

As illustrated in FIGS. 2A through 2C, in order to set the large-diameter paper roll 50*a*, the screw holes 71*a* of the upper case part 71 and the upper screw holes 72*a* of the lower case part 72 are aligned, and, then, screws 73 are used to threadably connect the upper case part 71 and the lower case part 72. With this arrangement, the recording sheet placement area for accommodating recording paper can be enlarged to allow the large-diameter paper roll 50*a* placed therein.

As illustrated in FIGS. 3A through 3C, in order to set the small-diameter paper roll 50*b*, the screw holes 71*a* of the upper case part 71 and the lower screw holes 72*b* of the lower case part 72 are aligned, and, then, screws 73 are used to threadably connect the upper case part 71 and the lower case part 72. With this arrangement, the recording sheet placement area for accommodating recording paper can be reduced in size to provide a small-sized printer while allowing the small-diameter paper roll 50*b* to be set therein.

In the manner described above, the present embodiment employs the case 70 of the printer main body 10 that is divided into the upper case part 71 and the lower case part 72, which allows the size of the case 70 to be changed by changing the positions at which thread connection is made. Namely, the connection points between the upper case part 71 and the lower case part 72 are changed to adjust the size of the case 70. With this arrangement, the size of the printer can be changed according to the size of a recording paper roll, and a small-sized printer can be provided when a small-diameter paper roll 50*b* is used.

Second Embodiment

Figure 5B:
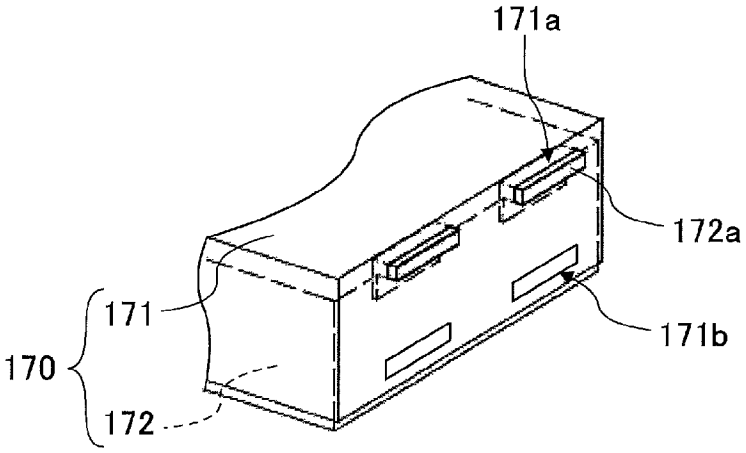
FIGS. 5A and 5B are drawings illustrating a printer of a second embodiment.
Figure 5A:
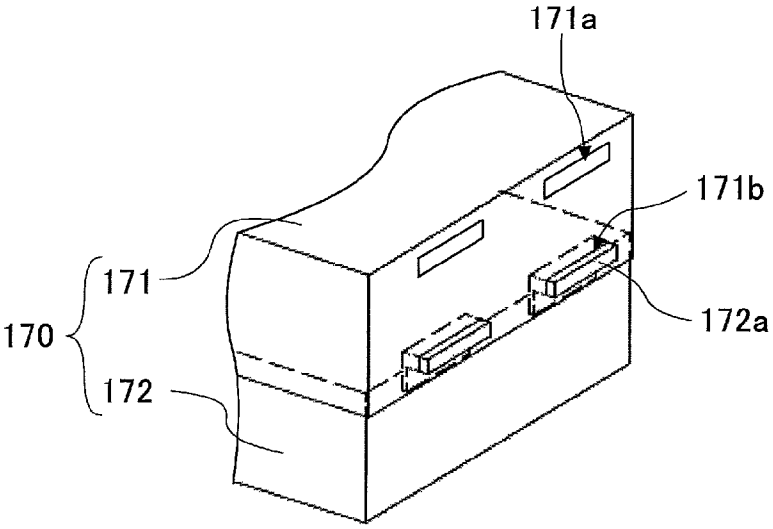

In the following, a second embodiment will be described. In the present embodiment, a case 170 of the printer main body 10 includes an upper case part 171 and a lower case part 172 as illustrated in FIGS. 5A and 5B. The upper case part 171 has a printer mechanism (not shown) mounted thereon. The upper case part 171 has upper openings 171*a* at the upper portion thereof, and has lower openings 171*b* at the lower portion thereof. The lower case part 172 has projections 172*a* outwardly extending from the lower case part 172 at the upper portion thereof. The upper case part 171 and the lower case part 172 are made of resin material or metal material.

As illustrated in FIG. 5A, in order to set a large-diameter paper roll, the projections 172*a* of the lower case part 172 are engaged with the lower openings 171*b* of the upper case part 171, thereby connecting the upper case part 171 and the lower case part 172 together. With this arrangement, the recording sheet placement area for accommodating recording paper can be enlarged to allow a large-diameter paper roll placed therein.

As illustrated in FIG. 5B, in order to set a small-diameter paper roll, the projections 172*a* of the lower case part 172 are engaged with the upper openings 171*a* of the upper case part 171, thereby connecting the upper case part 171 and the lower case part 172 together. With this arrangement, the recording sheet placement area for accommodating recording paper can be reduced in size to provide a small-sized printer while allowing a small-diameter paper roll to be set therein.

In the manner described above, the present embodiment employs the case 170 of the printer main body 10 that is divided into the upper case part 171 and the lower case part 172, which allows the size of the case 170 to be changed by changing the positions at which the projections 172*a* of the lower case part 172 are engaged. Namely, the connection points between the upper case part 171 and the lower case part 172 are changed to adjust the size of the case 170. With this arrangement, the size of the printer can be changed according to the size of a recording paper roll, and a small-sized printer can be provided when a small-diameter paper roll is used.

Configurations other than those described above are the same as or similar to those of the first embodiment.

Third Embodiment

Figure 6B:
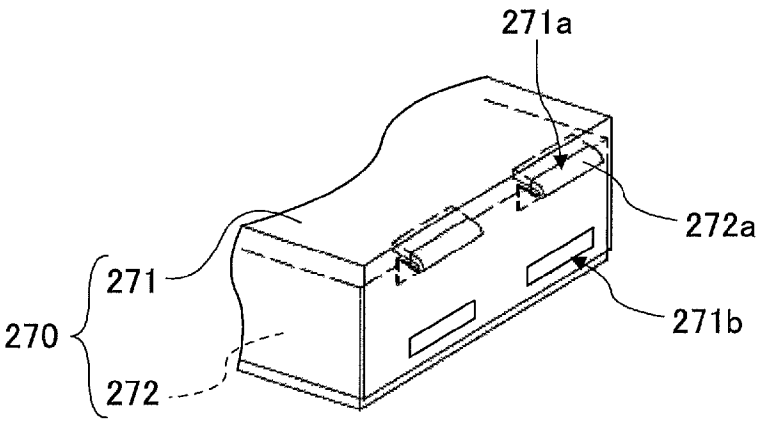
FIGS. 6A and 6B are drawings illustrating a printer of a third embodiment.
Figure 6A:
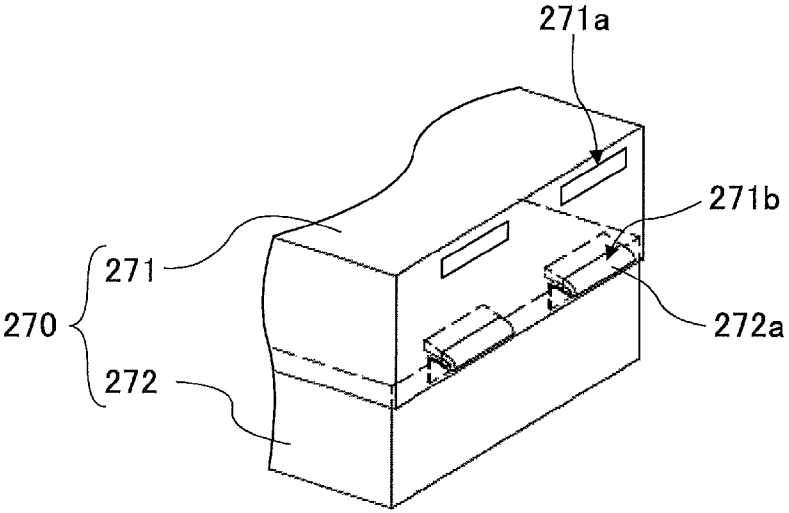

In the following, a third embodiment will be described. In the present embodiment, a case 270 of the printer main body 10 includes an upper case part 271 and a lower case part 272 as illustrated in FIGS. 6A and 6B. The upper case part 271 has a printer mechanism (not shown) mounted thereon. The upper case part 271 has upper openings 271*a* at the upper portion thereof, and has lower openings 271*b* at the lower portion thereof. The lower case part 272 has folded parts 272*a* outwardly extending from the lower case part 272 at the upper portion thereof. The folded parts 272*a* may be part of the lower case part 272 and may serve as a plate spring. The upper case part 271 and the lower case part 272 are made of resin material or metal material.

As illustrated in FIG. 6A, in order to set a large-diameter paper roll, the folded parts 272*a* of the lower case part 272 are engaged with the lower openings 271*b* of the upper case part 271, thereby connecting the upper case part 271 and the lower case part 272 together. With this arrangement, the recording sheet placement area for accommodating recording paper can be enlarged to allow a large-diameter paper roll placed therein.

As illustrated in FIG. 6B, in order to set a small-diameter paper roll, the folded parts 272*a* of the lower case part 272 are engaged with the upper openings 271*a* of the upper case part 271, thereby connecting the upper case part 271 and the lower case part 272 together. With this arrangement, the recording sheet placement area for accommodating recording paper can be reduced in size to provide a small-sized printer while allowing a small-diameter paper roll to be set therein.

In the manner described above, the present embodiment employs the case 270 of the printer main body 10 that is divided into the upper case part 271 and the lower case part 272, which allows the size of the case 270 to be changed by changing the positions at which the folded parts 272*a* of the lower case part 272 are engaged. Namely, the connection points between the upper case part 271 and the lower case part 272 are changed to adjust the size of the case 270. With this arrangement, the size of the printer can be changed according to the size of a recording paper roll, and a small-sized printer can be provided when a small-diameter paper roll is used.

Configurations other than those described above are the same as or similar to those of the first embodiment.

Fourth Embodiment

In the following, a fourth embodiment will be described. In the present embodiment, a case 370 of the printer main body 10 includes an upper case part 371 and a lower case part 372 as illustrated in FIGS. 7A and 7B and FIGS. 8A and 8B. The upper case part 371 has a printer mechanism (not shown) mounted thereon. The upper case part 371 has upper recesses 371*a* at the upper portion thereof, and has lower recesses 371*b* at the lower portion thereof. The lower case part 372 has wound springs 372*a* at the upper portion thereof. Each of the wound springs 372*a* has a folded part 372*b* at one end thereof outwardly extending from the lower case part 372. The upper case part 371 and the lower case part 372 are made of resin material or metal material.

Figure 7A:
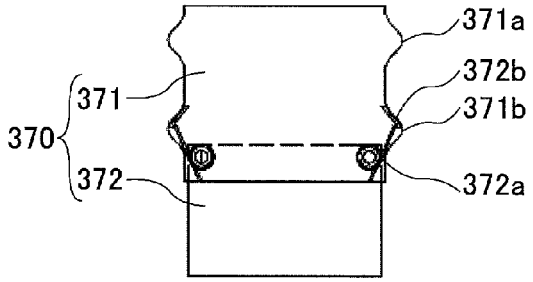
FIGS. 7A and 7B are drawings illustrating a printer of a fourth embodiment.
Figure 7B:
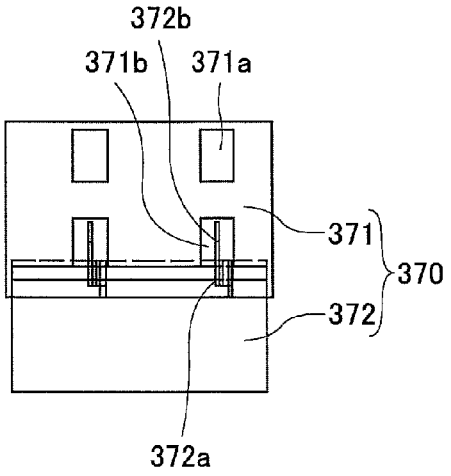

As illustrated in FIGS. 7A and 7B, in order to set a roll of recording paper having a large diameter, the folded parts 372*b* of the wound springs 372*a* of the lower case part 372 are brought in contact with the lower recesses 371*b* of the upper case part 371, thereby connecting the upper case part 371 and the lower case part 372 together. With this arrangement, the recording sheet placement area for accommodating recording paper can be enlarged to allow a large-diameter paper roll placed therein. FIG. 7A is a front view of the main part of the printer according to the present embodiment. FIG. 7B is a lateral view of the printer.

Figure 8A:
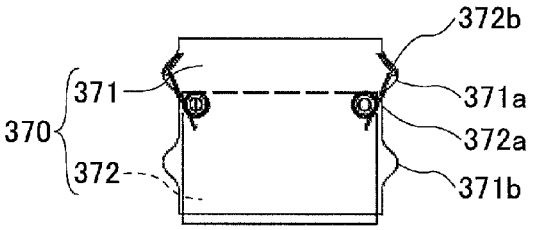
FIGS. 8A and 8B are drawings illustrating the printer of the fourth embodiment.
Figure 8B:
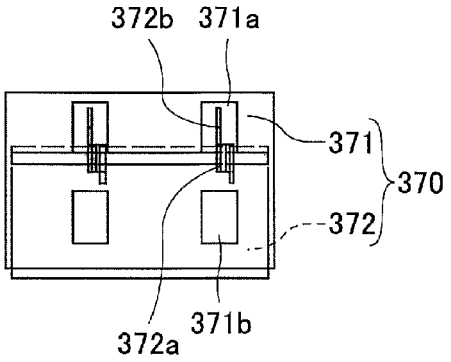

As illustrated in FIGS. 8A and 8B, in order to set a roll of recording paper having a small diameter, the folded parts 372*b* of the wound springs 372*a* of the lower case part 372 are brought in contact with the upper recesses 371*a* of the upper case part 371, thereby connecting the upper case part 371 and the lower case part 372 together. With this arrangement, the recording sheet placement area for accommodating recording paper can be reduced in size to provide a small-sized printer while allowing a small-diameter paper roll to be set therein. FIG. 8A is a front view of the main part of the printer according to the present embodiment. FIG. 8B is a lateral view of the printer.

In the manner described above, the present embodiment employs the case 370 of the printer main body 10 that is divided into the upper case part 371 and the lower case part 372, which allows the size of the case 370 to be changed by changing the positions with which the folded parts 372*b* of the wound springs 372*a* of the lower case part 372 come in contact. Namely, the connection points between the upper case part 371 and the lower case part 372 are changed to adjust the size of the case 370. With this arrangement, the size of the printer can be changed according to the size of a recording paper roll, and a small-sized printer can be provided when a small-diameter paper roll is used.

Configurations other than those described above are the same as or similar to those of the first embodiment.

Fifth Embodiment

In the following, a fifth embodiment will be described. In the present embodiment, a case 470 of the printer main body 10 includes an upper case part 471 and a lower case part 472 as illustrated in FIGS. 9A and 9B and FIGS. 10A and 10B. The upper case part 471 has a printer mechanism (not shown) mounted thereon. The upper case part 471 has, on inside walls thereof, interior projections 471*a*, 471*b*, 471*c*, and 471*d* inwardly extending, which are arranged in the order named from top to bottom. The lower case part 472 has, on outside walls thereof, exterior projections 472*a*, 472*b*, 472*c*, and 472*d* outwardly extending, which are arranged in the order named from top to bottom. The upper case part 471 and the lower case part 472 are made of resin material or metal material.

Figure 9A:
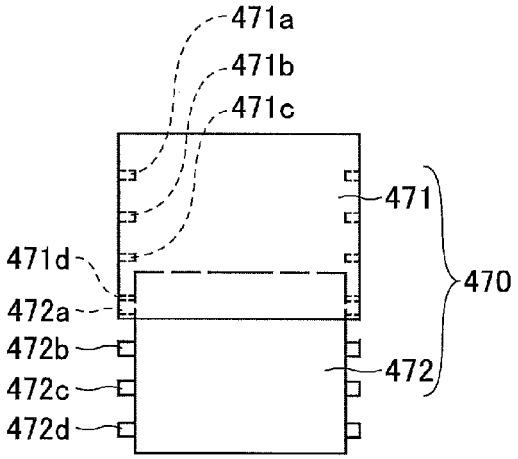
FIGS. 9A and 9B are drawings illustrating a printer of a fifth embodiment.
Figure 9B:
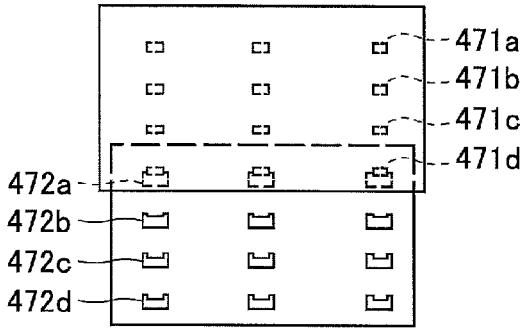

As illustrated in FIGS. 9A and 9B, in order to set a roll of recording paper having a large diameter, the interior projections 471*d* formed at the lower portion of the upper case part 471 are placed on the exterior projections 472*a* formed at the upper portion of the lower case part 472, thereby connecting the upper case part 471 and the lower case part 472. With this arrangement, the recording sheet placement area for accommodating recording paper can be enlarged to allow a large-diameter paper roll placed therein. FIG. 9A is a front view of the main part of the printer according to the present embodiment. FIG. 9B is a lateral view of the printer.

Figure 10A:
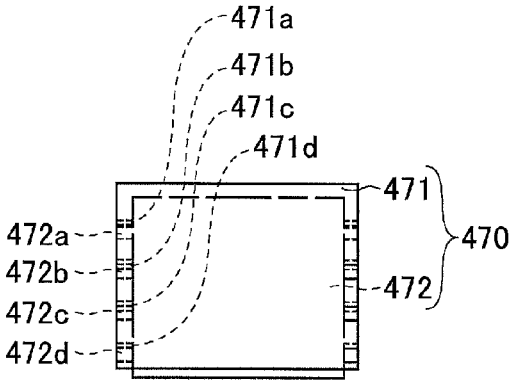
FIGS. 10A and 10B are drawings illustrating the printer of the fifth embodiment.
Figure 10B:
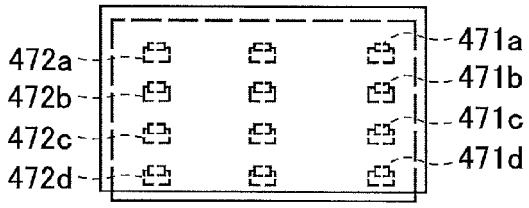

As illustrated in FIGS. 10A and 10B, in order to set a roll of recording paper having a small diameter, the interior projections 471*a* formed at the upper portion of the upper case part 471 are placed on the exterior projections 472*a* formed at the upper portion of the lower case part 472, thereby connecting the upper case part 471 and the lower case part 472. In this case, the interior projections 471*b* formed on the upper case part 471 may be placed on the exterior projections 472*b* formed on the lower case part 472. Further, the interior projections 471*c* formed on the upper case part 471 may be placed on the exterior projections 472*c* formed on the lower case part 471. Moreover, the interior projections 471*d* formed on the upper case part 471 may be placed on the exterior projections 472*d* formed on the lower case part 471. With this arrangement, the recording sheet placement area for accommodating recording paper can be reduced in size to provide a small-sized printer while allowing a small-diameter paper roll to be set therein. FIG. 10A is a front view of the main part of the printer according to the present embodiment. FIG. 10B is a lateral view of the printer.

In the manner described above, the present embodiment employs the case 470 of the printer main body 10 that is divided into the upper case part 471 and the lower case part 472, which allows the size of the case 470 to be changed by changing the positions at which the interior projections are placed with respect to the lower case part 472. Namely, the connection points between the upper case part 471 and the lower case part 472 are changed to adjust the size of the case 470. With this arrangement, the size of the printer can be changed according to the size of a recording paper roll, and a small-sized printer can be provided when a small-diameter paper roll is used.

Alternatively, while the upper case part 471 has the interior projections 471*a*, 471*b*, 471*c*, and 471*d*, the lower case part 472 may have only the exterior projections 472*a* at the upper portion thereof. Alternatively, while the lower case part 472 has the exterior projections 472*a*, 472*b*, 472*c*, and 472*d*, the upper case part 471 may have only the interior projections 471*d* at the lower portion thereof.

Configurations other than those described above are the same as or similar to those of the first embodiment.

Further, although the present invention is not limited to these embodiments, various variations and modifications may be made without departing from the scope of the present invention.

The present application is based on and claims the benefit of priority of Japanese priority application No. 2013-216729 filed on Oct. 17, 2013, with the Japanese Patent Office, the entire contents of which are hereby incorporated by reference.

What is claimed is:

1. A printer, comprising:

a print head configured to print on recording paper; and a printer main body having a case in which the recording paper is set, wherein the case includes a upper case part and a lower case part, and a size of an area for accommodating the recording paper inside the case is changeable by changing positions at which the upper case part and the lower case part are connected to each other, wherein the upper case part and the lower case part have screw holes, and are connected to each other by screws inserted into some of the screw holes, wherein one of the upper case part and the lower case part has the screw holes thereof situated at different vertical positions, and the size of the area for accommodating the recording paper inside the case is changeable by changing positions at which thread connection is made between the screw holes of the upper case part and the screw holes of the lower case part.

2. A printer, comprising:

a print head configured to print on recording paper; and a printer main body having a case in which the recording paper is set, wherein the case includes a upper case part and a lower case part, and a size of an area for accommodating the recording paper inside the case is changeable by changing positions at which the upper case part and the lower case part are connected to each other, wherein one of the upper case part and the lower case part has openings situated at different vertical positions, and another one of the upper case part and the lower case part has one or more projections, wherein the upper case part and the lower case part are connected by inserting the one or more projections into some of the openings, and wherein the size of the area for accommodating the recording paper inside the case is changeable by changing positions at which the one or more projections are inserted into some of the openings.

3. A printer, comprising:

a print head configured to print on recording paper; and a printer main body having a case in which the recording paper is set, wherein the case includes a upper case part and a lower case part, and a size of an area for accommodating the recording paper inside the case is changeable by changing positions at which the upper case part and the lower case part are connected to each other, wherein one of the upper case part and the lower case part has recesses situated at different vertical positions, and another one of the upper case part and the lower case part has one or more springs, wherein the upper case part and the lower case part are connected by inserting one or more respective ends of the one or more springs into some of the openings, and wherein the size of the area for accommodating the recording paper inside the case is changeable by changing positions at which the one or more respective ends of the one or more springs are inserted into some of the openings.

* * * * *